US010557284B2

(12) United States Patent
McMillen, Jr. et al.

(10) Patent No.: US 10,557,284 B2
(45) Date of Patent: Feb. 11, 2020

(54) FASTENING A PORTABLE SHADE APPARATUS TO A FENCE TO PROVIDE SHADE

(71) Applicants: Richard J. McMillen, Jr., Westborough, MA (US); David E. Huang, Westborough, MA (US)

(72) Inventors: Richard J. McMillen, Jr., Westborough, MA (US); David E. Huang, Westborough, MA (US)

( * ) Notice: Subject to any disclaimer, the term of this patent is extended or adjusted under 35 U.S.C. 154(b) by 0 days.

(21) Appl. No.: 15/843,672

(22) Filed: Dec. 15, 2017

(65) Prior Publication Data

US 2018/0171701 A1 Jun. 21, 2018

Related U.S. Application Data

(60) Provisional application No. 62/435,195, filed on Dec. 16, 2016.

(51) Int. Cl.

| | |
|---|---|
| ***E04H 15/58*** | (2006.01) |
| ***G09F 23/00*** | (2006.01) |
| ***E06B 9/24*** | (2006.01) |
| ***E04H 17/02*** | (2006.01) |

(52) U.S. Cl.

CPC ..... *E04H 15/58* (2013.01); *E04H 17/02* (2013.01); *E06B 9/24* (2013.01); *G09F 23/00* (2013.01)

(58) Field of Classification Search

CPC ..... E04H 15/36; E04H 15/58; E04H 15/40; E04H 15/32; E04H 15/405; E04H 17/00; E04H 17/161; E04H 1/22; E04H 17/02; E04F 10/10; E04F 10/02; E04F 10/04; E06B 9/24; A01G 9/22; G09F 23/00

USPC ... 135/87, 90, 124–126, 135, 160, 117, 119, 135/120.4, 906–907, 136; 256/1, 23–25, 256/27–28, 73; 52/23, 36.2, 56, 68, 74, 52/83, 91.1, 222, 240, 245; 473/415, 473/421; 160/135, 351; 119/482, 513, 119/516–517, 519, 523

See application file for complete search history.

(56) References Cited

U.S. PATENT DOCUMENTS

| | | | |
|---|---|---|---|
| 3,513,861 | A | 5/1970 | Johnson |
| 3,599,651 | A | 8/1971 | Perry |
| 4,165,757 | A | 8/1979 | Marks |
| 4,825,892 | A | 5/1989 | Norman |

(Continued)

FOREIGN PATENT DOCUMENTS

JP 09239192 A * 9/1997 ..... E04F 10/06

OTHER PUBLICATIONS

Fencescreen.com; "PVC Vinyl Coated Polyester Mesh Banner Material", http://www.fencescreen.com/Products/500-Series-Vinyl-Coated-Poly-Premium.aspx, pp. 1-6.

(Continued)

*Primary Examiner* — Winnie Yip
(74) *Attorney, Agent, or Firm* — BainwoodHuang

(57) ABSTRACT

A portable shade apparatus includes a sheet of material, a set of cables, and a set of flexible rods coupled to the sheet of material and the set of cables. Each flexible rod has (i) a first end section which projects from the sheet of material, (ii) a second end section which fastens to a respective cable, and (iii) an inner section between the first end section and the second end section. The inner section provides support to the sheet of material.

20 Claims, 12 Drawing Sheets

(56) References Cited

U.S. PATENT DOCUMENTS

| | | | | |
|---|---|---|---|---|
| 5,035,253 | A | 7/1991 | Bortles | |
| 5,096,257 | A * | 3/1992 | Clark | A47C 1/143 297/184.15 |
| 5,546,971 | A * | 8/1996 | Leonhardt | E04H 15/003 135/123 |
| 5,752,537 | A | 5/1998 | Kranzler | |
| 5,927,311 | A | 7/1999 | Jager | |
| 6,050,280 | A * | 4/2000 | Jeske | E04H 15/08 135/115 |
| 6,796,359 | B1 * | 9/2004 | Knutson | E04F 10/04 135/88.12 |
| 7,059,660 | B1 * | 6/2006 | Juola | E04H 15/06 135/88.01 |
| 7,427,101 | B1 | 9/2008 | Zernov | |
| 7,721,361 | B1 * | 5/2010 | Shubert | E04H 4/108 4/494 |
| 8,573,565 | B1 * | 11/2013 | Lyndaker | A63B 71/0054 256/23 |
| 8,720,461 | B2 * | 5/2014 | Nichols | E04H 15/44 135/117 |
| 9,072,368 | B2 | 7/2015 | Mueller | |
| 9,834,953 | B2 | 12/2017 | Ways | |
| 2017/0030083 | A1 * | 2/2017 | Matturro | E04F 10/02 |
| 2018/0251196 | A1 * | 9/2018 | Craig | E04F 10/02 |

OTHER PUBLICATIONS

Amazon.com, "Coleman Instant Canopy Sunwall", https://www.amazon.com/dp/B00AU6JQ6S, pp. 1-8.

* cited by examiner

FASTENING A PORTABLE SHADE APPARATUS TO A FENCE TO PROVIDE SHADE

BACKGROUND

A conventional transportable canopy kit includes a canvas canopy, a hinged aluminum frame attached to the canvas canopy, and a carrying case. While the conventional transportable canopy is in transit, the canvas canopy and the hinged aluminum frame remain in a folded state within the carrying case.

During setup, a human user removes the canvas canopy and the hinged aluminum frame from the carrying case. The human user then unfolds the hinged aluminum frame in an umbrella-like manner to fully open the canvas canopy. The human user then extends legs of the hinged aluminum frame to provide headroom underneath the canvas canopy.

SUMMARY

Unfortunately, there are deficiencies to the above-described conventional transportable canopy kit which has a hinged aluminum frame. Along these lines, the conventional transportable canopy kit is not well-suited for installation and operation over permanent bench adjacent a fence such as a fenced dugout area of a ballfield. For example, to use the kit in such an area, the kit may need to be setup away from the fenced dugout area and then moved while in the fully opened state (e.g., by multiple human users holding the multiple legs) to the fenced dugout area. Such operation may be awkward and burdensome on multiple users.

Additionally, while the kit is fully opened over the fenced dugout area, wind gusts may nevertheless lift one or more legs off the ground thus posing a nuisance to any humans sitting in the dugout area. Moreover, the canvas canopy may trap heat and unnecessarily darken the space underneath.

Furthermore, a conventional overhead canopy provides little to no protection from the sun while the sun is rising or setting. During these times of the day, sunlight may come in at an angle that still leaves humans under the conventional canopy in direct sunlight. Also, as the sun moves across the sky over time, the conventional canopy casts shadows in different directions and over different locations (forcing those underneath to keep moving) and, because of the size and shape of the conventional canopy, it is difficult to maneuver the conventional canopy into an optimal position.

In contrast to the above-described conventional transportable canopy kit which is poorly-suited for installation and operation over permanent bench adjacent a fence such as a fenced dugout area of a ballfield, improved techniques are directed to use of a portable shade apparatus which fastens to a fence (or fence-like structure) to provide shade. Such an apparatus can be installed and positioned by a single human over the immediate area to receive optimal and maximum shade from the apparatus. Additionally, since such an apparatus fastens to a fence, the apparatus receives support from the fence during wind gusts.

One embodiment is directed to a portable shade apparatus which includes a sheet of material, a set of cables, and a set of flexible rods coupled to the sheet of material and the set of cables. Each flexible rod has (i) a first end section which projects from the sheet of material, (ii) a second end section which fastens to a respective cable, and (iii) an inner section between the first end section and the second end section. The inner section provides support to the sheet of material.

In some arrangements, the inner section of each flexible rod bends in an arc to prop up the sheet of material as a shade when the first end section of that flexible rod fastens to a fence and the second end section of that flexible rod is pulled under tension by a respective cable.

In some arrangements, the first end section of each flexible rod projects from the sheet of material in a cantilevered manner to fasten to the fence.

In some arrangements, the first end section of each flexible rod of the set of flexible rods projects from the sheet of material by at least four inches while propping up the sheet of material as the shade.

In some arrangements, the fence is a chain link fence. In these arrangements, the first end section of each flexible rod is bendable to permit weaving of the first end section of that flexible rod through openings in the chain link fence to attach that flexible rod to the fence.

In some arrangements, each flexible rod is formed uniformly of a polymeric substance that provides elasticity while under tension. Suitable materials for the flexible rods include carbon fiber, fiberglass, and similar types of plastic material.

In some arrangements, each cable of the set of cables has (i) a rod end that attaches to the second end section of a respective flexible rod of the set of flexible rods and (ii) an anchor end which anchors to an anchor point.

In some arrangements, the anchor point is a portion of a fence. Here, the anchor end of each cable includes a mechanical coupler to anchor that cable to the portion of the fence.

In some arrangements, the fence is a chain link fence and the mechanical coupler of each cable is a metallic clasp that fits around a wire of the chain link fence to anchor that cable to the chain link fence. Such metallic clasps may be spring loaded for quick and simple attachment and detachment.

In some arrangements, the sheet of material has (i) a left edge which is supported by a first flexible rod and (ii) a right edge which is supported by a second flexible rod. Here, the left edge of the sheet of material may define a left sleeve that holds the first flexible rod and a right sleeve that holds the second flexible rod.

In some arrangements, at least a portion of the sheet of material is semitransparent allowing light to at least partially pass therethrough when the sheet of material is taut. Suitable materials include various translucent fabrics, plastics, and other types of textiles.

In some arrangements, the sheet of material includes a set of banner location areas for displaying a set of banners. For example, a central region of the sheet disposed between the left edge and the right edge may provide a presentation surface for banner display. As another example, an edge region of the sheet may provide places to hang or attach one or more banners.

In some arrangements, the portable shade apparatus further includes a lateral support member which extends between the left edge and the right edge to control lay of the sheet of material. Such a support member may provide support to the sheet particularly if the sheet covers a long bench.

In some arrangements, the portable shade apparatus further includes an elongated bag. Here, the sheet of material, the set of cables, and the set of flexible rods are constructed and arranged to fit within the elongated bag during transportation of the portable shade apparatus.

In some arrangements, each flexible rod is operative to separate into multiple rod sections. Such a feature enables convenient disassembly for storage and/or transport within a relatively small bag (e.g., the bag may fit easily into a trunk of a vehicle).

Another embodiment is directed to a method for installing a portable shade apparatus on a fence adjacent a bench area of an athletic field. The method includes unfurling the portable shade apparatus. The portable shade apparatus includes a sheet of material, a set of cables, and a set of flexible rods coupled to the sheet of material and the set of cables. Each flexible rod of the set of flexible rods has (i) a first end section which projects from the sheet of material, (ii) a second end section which fastens to a respective cable of the set of cables, and (iii) an inner section between the first end section and the second end section, the inner section providing support to the sheet of material. The method further includes, after the portable shade apparatus is unfurled, inserting the first end section of each flexible rod of the set of flexible rods through openings in the fence adjacent the bench area of the athletic field. The method further includes anchoring each cable of the set of cables to a respective anchor point to bend the set of flexible rods in a manner which holds the sheet of material taut in the form an arc while the sheet of material provides shade over the bench area.

In some arrangements, anchoring each cable of the set of cables includes attaching each cable to a respective original location on the fence. Additionally, the method may further include re-attaching each cable to a respective new location on the fence to maintain shade over the bench area.

Other embodiments are directed to components, kits, related equipment, and so on which involve the use of a portable shade apparatus which fastens to a fence or fence-like structure to provide shade.

BRIEF DESCRIPTION OF THE DRAWINGS

The foregoing and other objects, features and advantages will be apparent from the following description of particular embodiments of the present disclosure, as illustrated in the accompanying drawings in which like reference characters refer to the same parts throughout the different views. The drawings are not necessarily to scale, emphasis instead being placed upon illustrating the principles of various embodiments of the present disclosure.

DETAILED DESCRIPTION

An improved technique is directed to fastening a portable shade apparatus to a fence to provide shade. Such an apparatus can be installed by a single human over the immediate area to receive shade. Additionally, since such an apparatus fastens to a fence, the apparatus receives support from the fence during wind gusts.

The various individual features of the particular arrangements, configurations, and embodiments disclosed herein can be combined in any desired manner that makes technological sense. Additionally, such features are hereby combined in this manner to form all possible combinations, variants and permutations except to the extent that such combinations, variants and/or permutations have been expressly excluded or are impractical. Support for such combinations, variants and permutations is considered to exist in this document.

Figure 1:
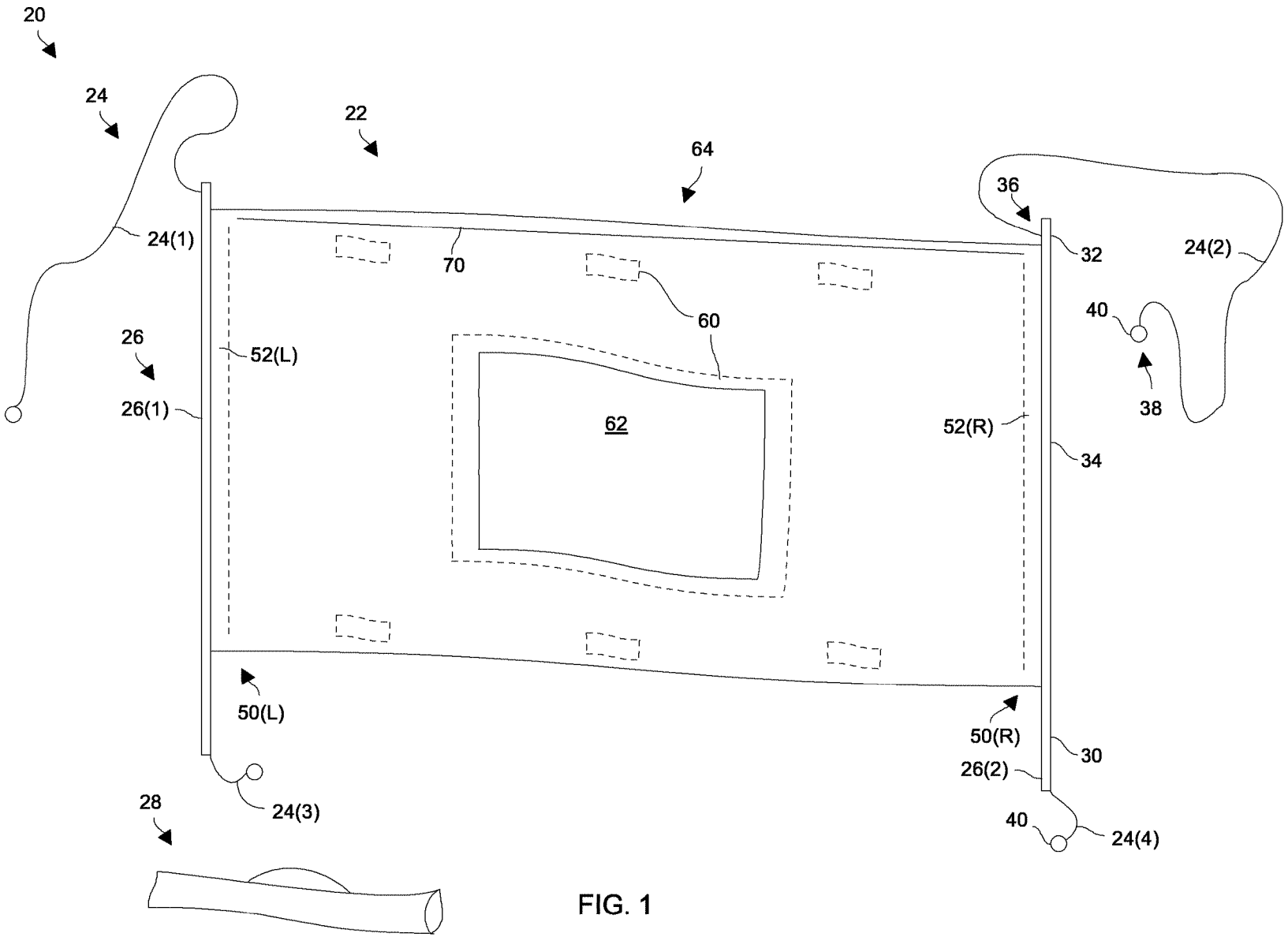
FIG. 1 is a perspective view of an example portable shade apparatus in accordance with certain embodiments and which fastens to a fence or fence-like structure to provide shade.

FIG. 1 shows a portable shade apparatus 20 which fastens to a fence (or fence-like structure) to provide shade. The portable shade apparatus 20 includes a sheet of material 22, cables 24(1), 24(2), 24(3), 24(4) (collectively, cables 24), flexible rods 26(1), 26(2) (collectively, rods 26), and a bag 28 to carry the various components before and after installation.

As shown in FIG. 1, each flexible rod 26 (e.g., see the flexible rod 26(2)) has (i) a first end section 30 which projects from the sheet of material 22 and which fastens to a respective cable 24, (ii) a second end section 32 which fastens to a respective cable 24, and (iii) an inner (or mid) section 34 between the first end section 30 and the second end section 32. The inner section 34 provides support to the sheet of material 22 (e.g., controls how the sheet of material 22 lays, holds the sheet of material 22 taut, etc.).

In accordance with certain embodiments, each flexible rod 26 is constructed and arranged to bend in a spring like manner. That is, the normal bias for each flexible rod 26 is to remain in a straight orientation as shown in FIG. 1. If a flexible rod 26 is bent due to displacement force, the flexible rod 26 returns to the straight orientation once the displacement force is removed. Suitable materials for the flexible rods 26 include carbon fiber, fiberglass, molded plastic, and similar types of plastic material.

Additionally, in accordance with certain embodiments, the sheet of material 22 extends for the majority of the length of each flexible rod 26. Example suitable coverage of the sheet of material along the flexible rods 26 includes 90%, 80%, 70% and so on. In some arrangements, less than a foot of each flexible rod 26 extends from the sheet of material 22 to maximize surface for shade while concurrently providing suitable rod sections for reliably attaching to a fence.

Furthermore, in accordance with certain embodiments, the sheet of material 22 is formed from a single contiguous material swatch. In other embodiments, the sheet of material 22 is formed from multiple material swatches or segments (e.g., two, three, etc.) arranged in a side-by-side or overlapping manner along the flexible rods 26.

As further shown in FIG. 1, each cable 24 has (i) a rod end 36 that attaches to an end section 30, 32 of a respective flexible rod 26 and (ii) an anchor end 38 which anchors to an anchor point. In some arrangements, the anchor end 38 of each cable 24 includes a mechanical coupler 40 (e.g., a clamp, a clasp, etc.) to anchor that cable 24 to a portion of a fence.

During operation, when the portable shade apparatus 20 properly fastens to a fence, the sheet of material 22 provides shade. In particular, the sheet of material 22 is supported by the flexible rods 26 to form a covering surface to cast a shadow over an area (e.g., a permanent bench area adjacent the fence).

In some arrangements, the sheet of material 22 has a left edge 50(L) which is supported by a first flexible rod 26 (i.e., the rod 26(1) in FIG. 1) and a right edge 50(R) which is supported by a second flexible rod 26 (i.e., the rod 26(2) in FIG. 1). In some arrangements, the left edge 50(L) of the sheet of material 22 defines a left sleeve 52(L) (i.e., a hollow tube) that holds the first flexible rod 26 and a right sleeve 52(R) that holds the second flexible rod 26.

In some arrangements, at least a portion of the sheet of material 22 is semitransparent (e.g., a mesh) allowing light to at least partially pass therethrough when the sheet of material 22 is taut. Suitable materials for the sheet 22 include various translucent fabrics, plastics, and other types of textiles. In some embodiments, the sheet of material 22 includes perforations that allow air to pass therethrough (i.e., breathe through) while nevertheless inhibiting at least some sunlight penetration.

In some arrangements, the sheet of material 22 includes a set of banner location areas 60 for displaying a set of banners 62. For example, a central region of the sheet 22 disposed between the left edge 50(L) and the right edge 50(R) may provide a presentation surface for banner display. As another example, an edge region 64 of the sheet 22 may provide places to hang or attach one or more banners. It should be understood that a variety of techniques may be employed to provide the banners such as silk screening or other types of printing, inserting a banner into a built-in transparent pocket, attaching a banner using fasteners such as hook-and-loop materials, and so on. As a result, a team sitting and/or standing in the bench area is able to display team information (e.g., the team's home location, the team's name, the team's colors, logos, advertisements, combinations thereof, etc.).

In some arrangements, the portable shade apparatus 20 further includes a lateral support member 70 which extends between the left edge 42(L) and the right edge 42(R) to control lay of the sheet of material 22. Such a support member 60 (e.g., a bar, a rod, etc.) may provide lateral or horizontal support to the sheet 22 particularly if the sheet 22 covers a long bench. Further details will now be provided with reference FIG. 2.

Figure 2:
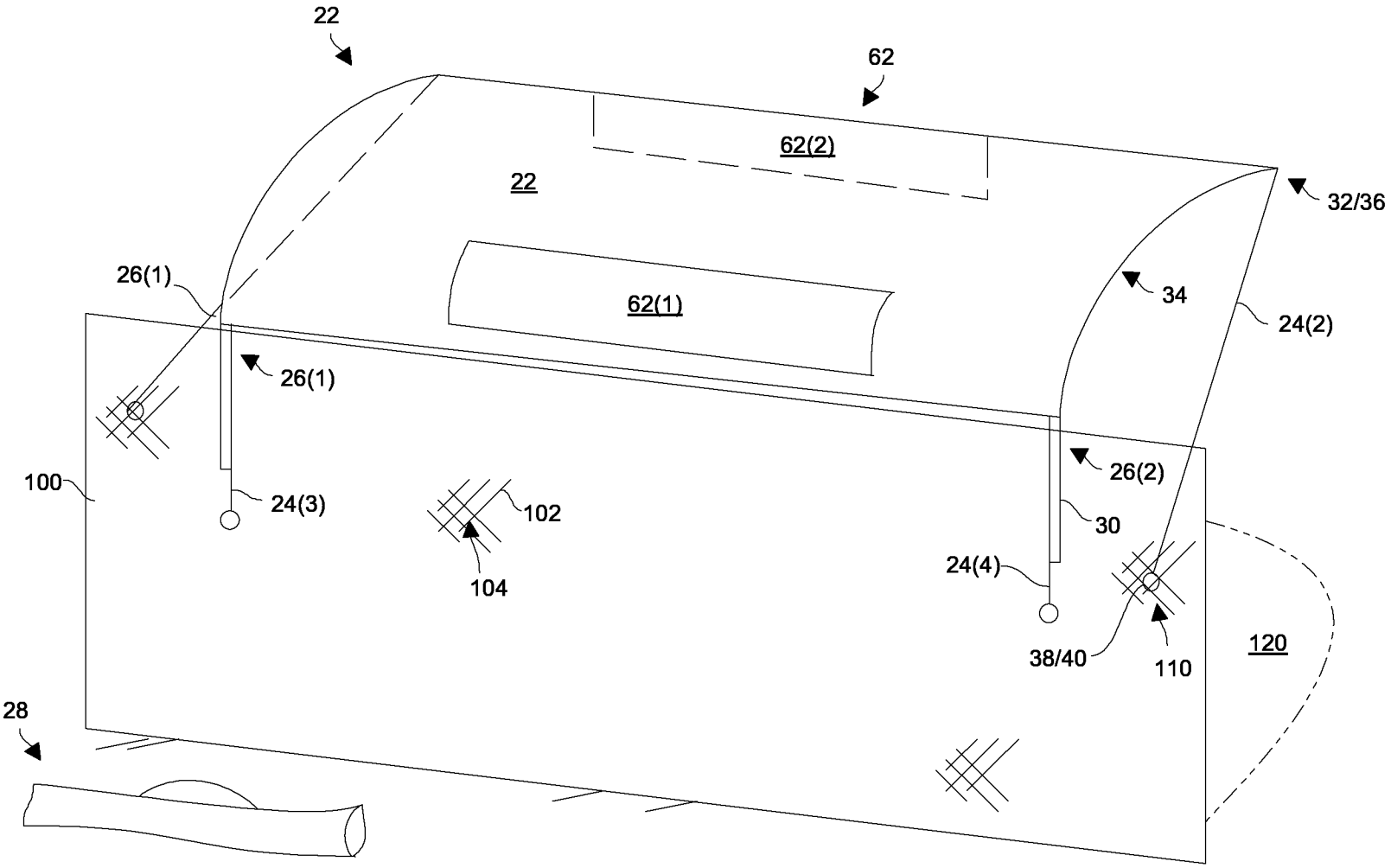
FIG. 2 is a perspective view of the example portable shade apparatus of FIG. 1 while fastened to a fence.

FIG. 2 shows the portable shade apparatus 20 fastened to a fence (or fence-like structure) 100. In some arrangements, the fence 100 is a chain link (or wire mesh) fence having wires 102 that form openings 104. In particular, the fence 100 extends perpendicularly from the ground and may be adjacent a permanent bench area 120 of an athletic field (e.g., a dugout of a ballfield, a permanent bench or dugout area for players to sit and watch a ballgame, etc.). Suitable alternative fence-like structures include vertical legs of decks, pavilions, canopy tents, and the like.

To install the portable shade apparatus 20, a user inserts the first end sections 30 through the openings 104 in the fence 100. In particular, the user threads the first end section 30 of each flexible rod 26 by weaving the first end section 30 through the fence openings 104 until that flexible rod 26 is supported by the fence 100. Additionally, the user pulls the cable 24 which is attached to the first end section 30 taut and secures the cable 24 to the fence 100 using a clamp 40 (also see FIG. 2). In some arrangements, the first end section 30 of each flexible rod 26 is provisioned with an extra locking feature that further secures the first end section 30 to the fence 100 (e.g., a groove, a notch, another fastener, etc.). Alternatively, the fence 100 may include holders (e.g., portions of pipe) through which the first end sections 30 insert.

As shown in FIG. 2, the inner section 34 of each flexible rod 26 bends from an original straight state into an arc to prop up the sheet of material 22 as a shade when the first end section 30 of that flexible rod 26 fastens to the fence 100 and the second end section 32 of that flexible rod 26 is pulled under tension by a respective cable 24. In some arrangements, the cables 24(1), 24(2) not only pull the second end sections 32(1), 32(2) in the downward direction, the cables 24 also pull the second end sections 32(1), 32(2) away from each other to maintain tension in the sheet of material 22.

In some arrangements, the first end section 30 of each flexible rod 26 projects from the sheet of material 22 in a cantilevered manner to fasten to the fence 100. In some arrangements, the first end section 30 of each flexible rod 26 projects from the sheet of material 22 by a suitable length to receive stability from the fence 100 (e.g., by six inches, 10 inches, 14 inches, by 18 inches, by 24 inches, etc.) while propping up the sheet of material 22 as the shade. The flexible rods 26 can be formed uniformly of a polymeric substance that provides plasticity and elasticity while under tension. Due to such features, a user is able to easily maneuver (e.g., sew) the first end sections 30 through openings 104 between the wires 102 of the fence 100.

Additionally, in some arrangements, the flexible rods 26 can be formed from separate rod sections that attach at their ends (e.g., where one rod end inserts into another rod end) thus enabling disassembly and compact storage. Along these lines, the various components of the portable shade apparatus 20 are then able to fit within a smaller (e.g., shorter) bag 28 (also see FIG. 1) for more convenient transport. For example, the bag 28 may then be approximately 3.5 feet long (or less) similar to a portable chair bag.

Figure 2A:
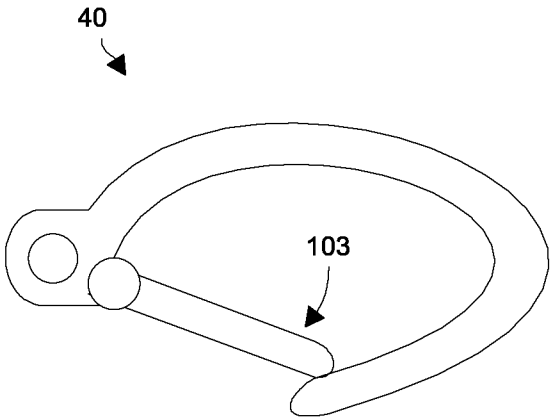
FIG. 2A is a perspective view of a mechanical coupler which is suitable for an example portable shade apparatus in accordance with certain embodiments.

As further shown in FIG. 2, the fence 100 is, by way of example, a chain link fence and the mechanical coupler 40 of each cable 24 is a connector that connects the cable end 38 to the fence 100. In some arrangements, the coupler 40 is a metallic clasp that fits around a wire 102 of the chain link fence to anchor that cable to the chain link fence. Such metallic clasps may be spring loaded for quick and simple attachment and detachment (e.g., also see FIG. 2A showing an example coupler 40 which is spring biased in a direction 103). Other types of fasteners are suitable for use as well such as clamps, hooks, and so on. In some arrangements, the portable shade apparatus 20 includes tubes that initially fasten to vertical supports (e.g., fence posts, legs, etc.) and then the ends 30 of the flexible rods 26 insert into the tubes thereby fastening to another fence-like structure.

With the portable shade apparatus 20 installed on the fence 100 as shown in FIG. 2, the sheet of material 22 casts a shadow over the bench area 120. The locations of the anchor ends 38 of the cables 24 control the amount of arc or curvature in the rods 26 and thus how the sheet of material 22 casts a shadow over the bench area 120. The user can change the locations of the anchor ends 38 to change the amount of curvature so that the shadow is maintained over the bench area 120 as the sun moves across the sky.

It should be understood that, in some arrangements, the sheet of material 22 is at least partially see thru thus enabling humans sitting or standing in the bench area 120 to at least partially view the sky and/or plays in the field. Further details will now be provided with reference to FIG. 3.

Figure 3:
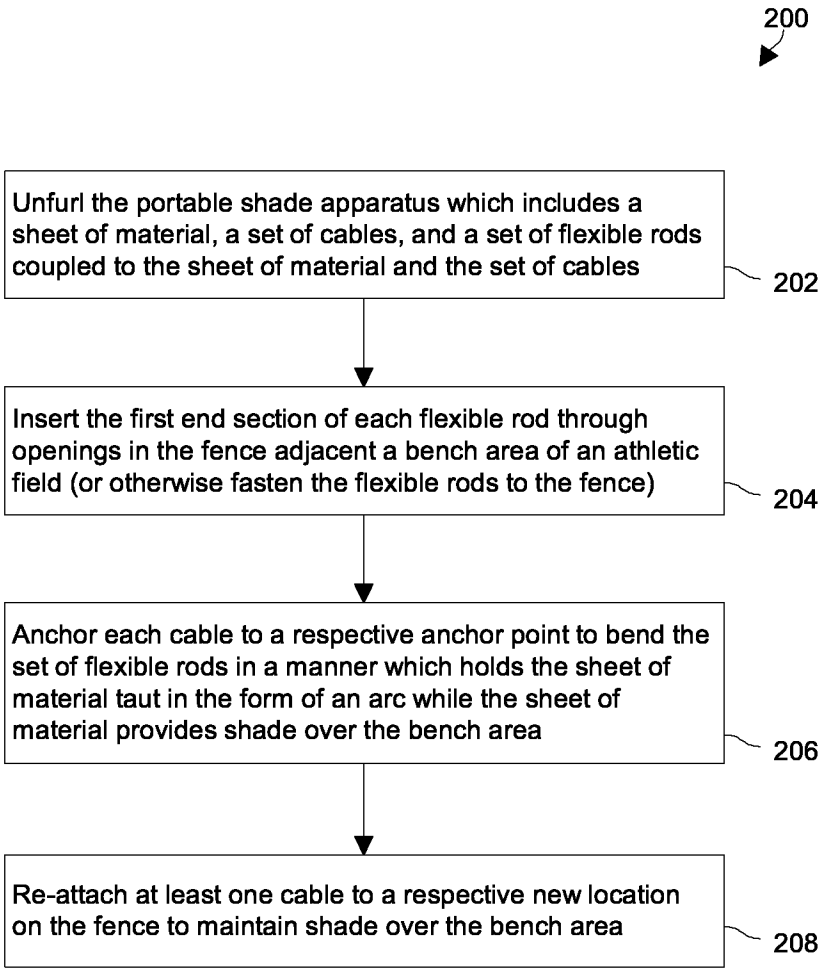
FIG. 3 is a flowchart of a procedure in accordance with certain embodiments and which is performed by a set of users when installing a portable shade apparatus to a fence.

FIG. 3 is a flowchart of a procedure 200 which is performed by a user (or multiple users) when installing the portable shade apparatus 20 on a fence 100 adjacent a bench area of an athletic field. At 202, the user unfurls (or opens up for installation) the portable shade apparatus 20 which, as mentioned earlier, includes a set of cables, and a set of flexible rods coupled to the sheet of material and the set of cables (also see FIGS. 1 and 2).

At 204, after the portable shade apparatus 20 is unfurled, the user inserts the first end section of each flexible rod through openings in the fence adjacent a bench area of an athletic field. There are alternative ways to supporting the flexible rods from the fence such as inserting the ends of the rods into portions of pipe that are secured to the fence, and so on.

At 206, the user anchors each cable to a respective anchor point to bend the set of flexible rods in a manner which holds the sheet of material taut in the form an arc while the sheet of material provides shade over the bench area. Such activity may involve operating clasps or similar types of fasteners at the ends of the cables to the fence.

At 208, the user optionally re-attaches at least one cable to a respective new location on the fence to maintain shade over the bench area. Here, the user may change the amount of arc or curvature based on the angle of the sun in order to maintain shade over the bench area. For example, the user may move the fastening locations of the cables 24(1), 24(2) (i.e., where the clamps 40 attach to the fence 100, also see FIGS. 5 through 7) to change the orientation of the shade.

As described above, improved techniques are directed to fastening a portable shade apparatus 20 to a fence 100 to provide shade. Such an apparatus 20 can be installed by a single human over the immediate area to receive shade. Additionally, since such an apparatus 20 fastens to a fence 100, the apparatus 20 receives support from the fence 100 during wind gusts.

While various embodiments of the present disclosure have been particularly shown and described, it will be understood by those skilled in the art that various changes in form and details may be made therein without departing from the spirit and scope of the present disclosure as defined by the appended claims.

For example, it should be understood that the fence 100 to which the portable shade apparatus 20 attaches does not need to be in a single plane. Rather, the fence 100 may be formed by various angles and different fence portions to form a bench area or player area. Along these lines, the fence 100 may form a room with one or more openings for players to walk through. The various portions of the fence may intersect each other at any angle (e.g., 45 degrees, 90 degrees, etc.).

Figure 4:
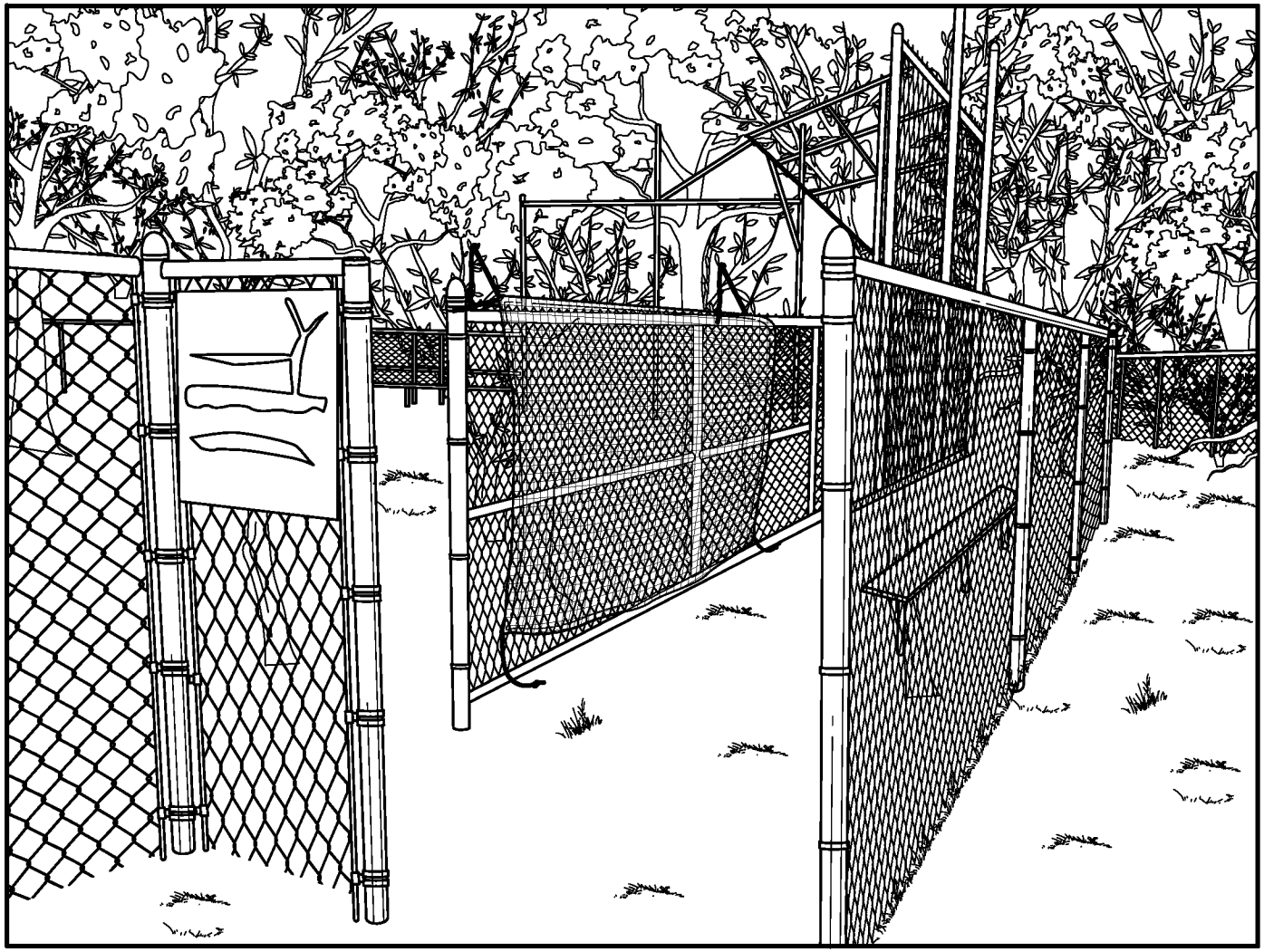
FIG. 4 shows a bench area with another example portable shade apparatus in a partially or fully installed state.

FIG. 4 shows a bench area 120 with an example portable shade apparatus 20 in a partially or fully installed state. Here, the sheet of material 22 is tied to a fence 100 as a precaution, but none of the flexible rods 24 currently engage the fence 100.

As shown in FIG. 4, the sheet of material 22 is somewhat see-thru (e.g., a thin woven mesh). That is, the sheet 22 allows humans to see through the material but nevertheless blocks at least some amount of sunlight to provide shade. Moreover, the material breathes (e.g., via holes through the weavings) thus preventing heat buildup and providing less resistance to wind gusts than solid canvas material.

While the portable shade apparatus 20 is in this partially or fully installed state, the flexible rods 26 are no necessary. Likewise, the lateral support member 70 may be omitted from use.

Figure 5:
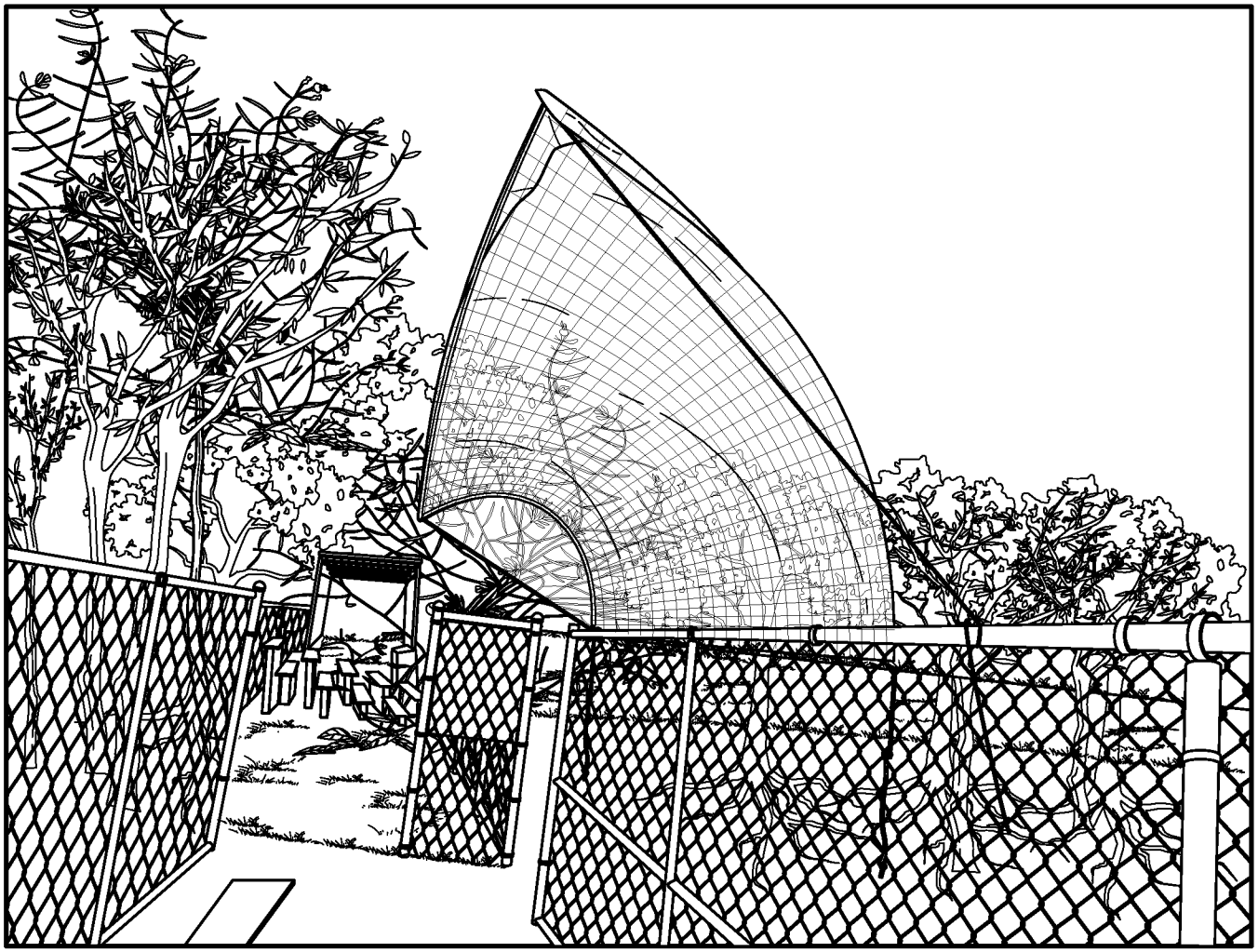
FIG. 5 shows the example portable shade apparatus of FIG. 4 from a different angle and in another installed state.

FIG. 5 shows the bench area 120 from a different angle and with the example portable shade apparatus 20 in a fully installed state. Here, the first end sections 30 of the flexible rods 24 are inserted through the fence holes 104 to secure the lower portion of the portable shade apparatus 20 to the fence 100. Additionally, the cables 26 pull down the second end sections 32 of the flexible rods 24 to form an arc and secure the upper portion of the portable shade apparatus 20 to the fence 100.

Figure 6:
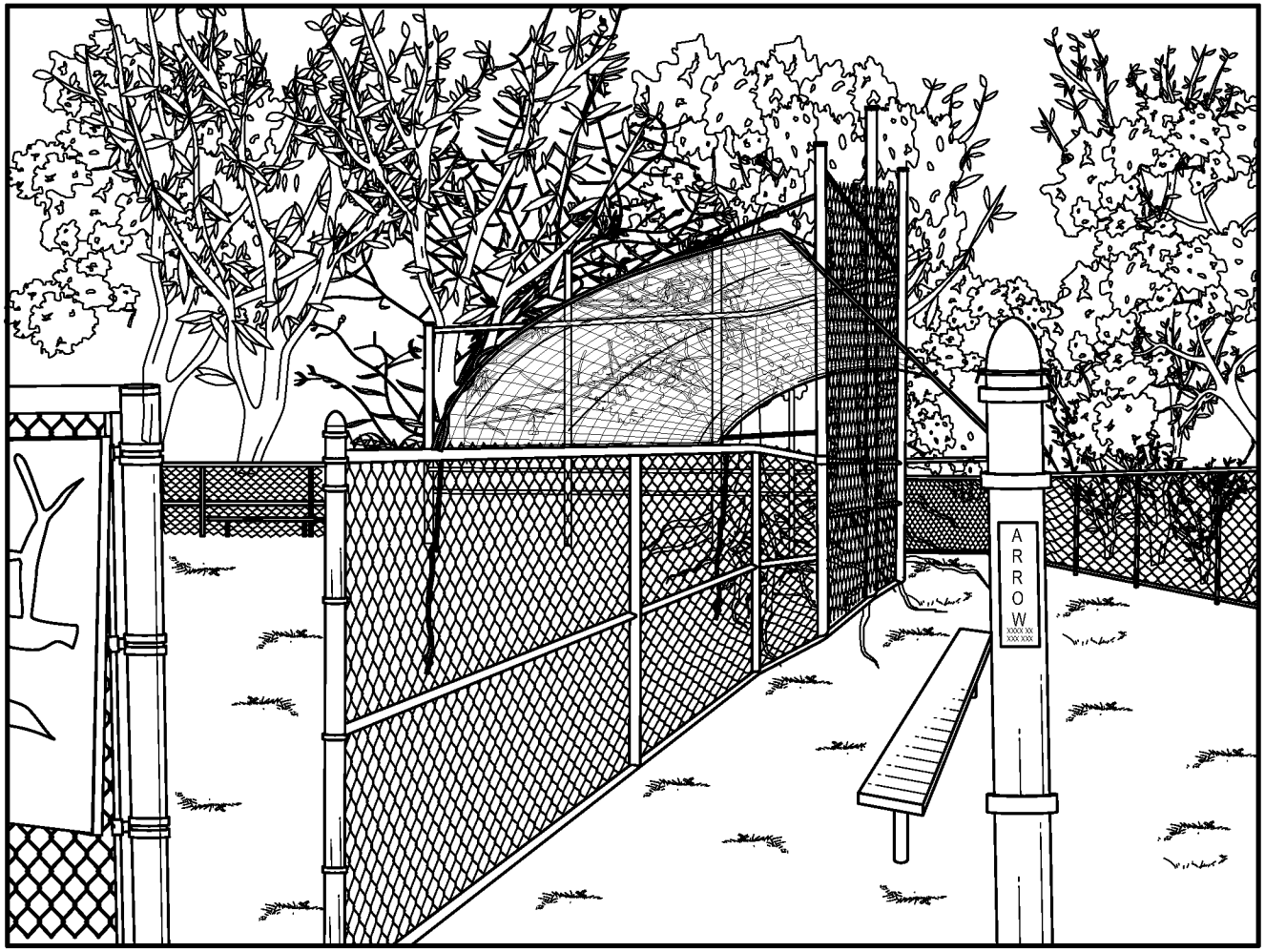
FIG. 6 shows the example portable shade apparatus of FIG. 4 from another angle and in yet another installed state.
Figure 7:
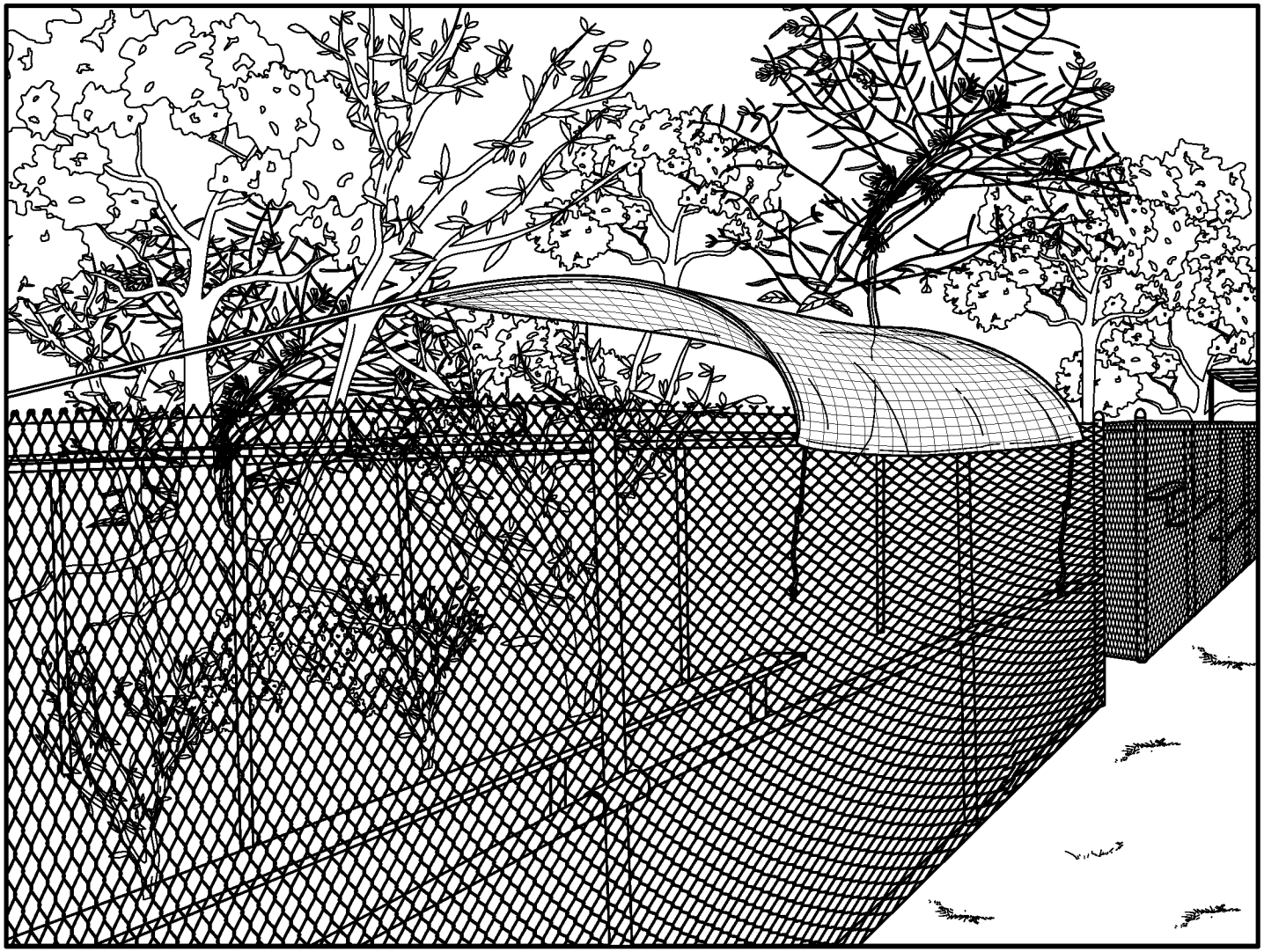
FIG. 7 shows the example portable shade apparatus of FIG. 4 from another angle.
Figure 8:
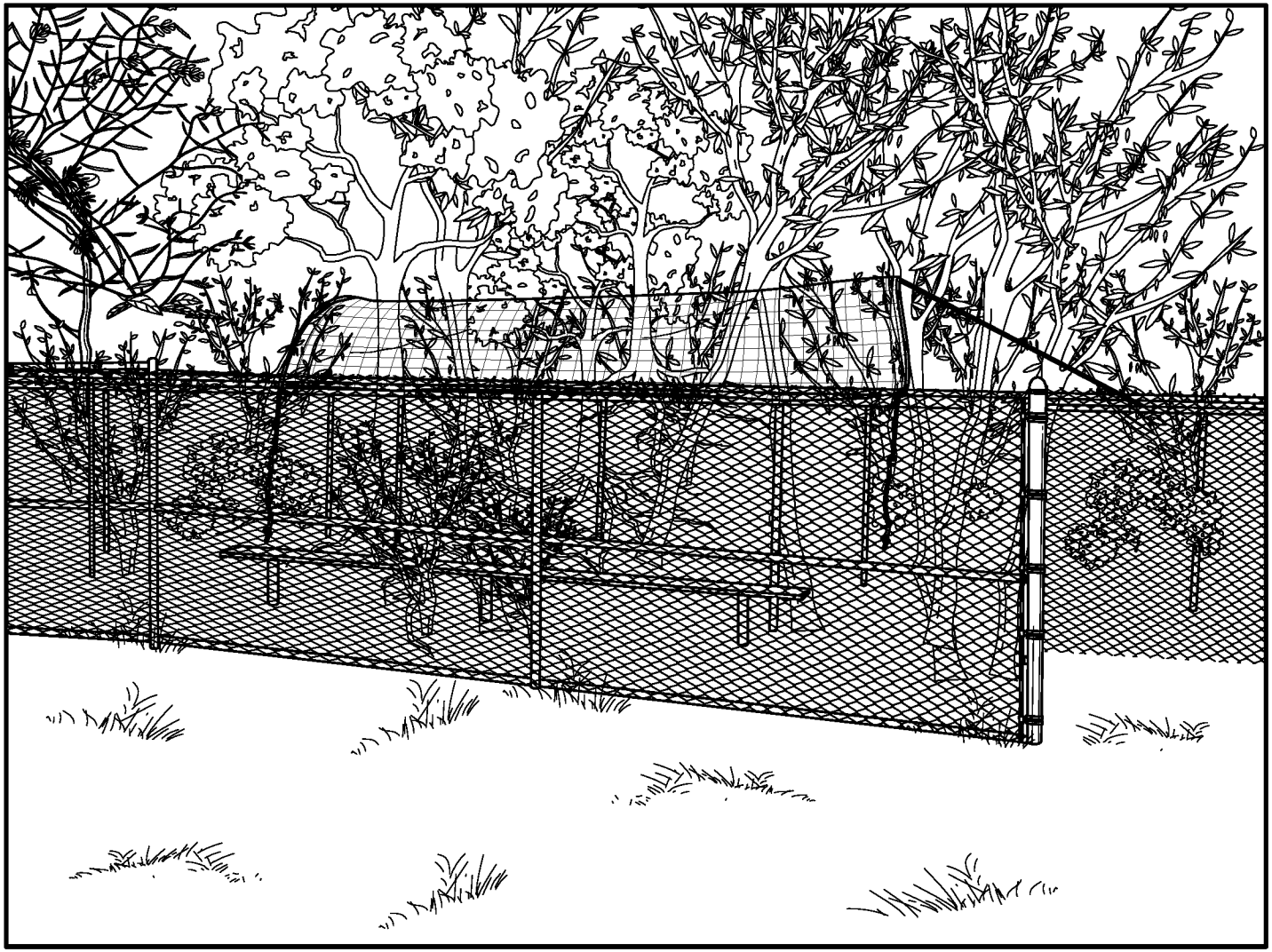
FIG. 8 shows the example portable shade apparatus of FIG. 4 from yet another angle.

FIGS. 6, 7 and 8 show the example portable shade apparatus 20 with the cables 26 holding down the upper portion of the portable shade apparatus 20 in a manner which is different than that shown in FIGS. 4 and 5. FIG. 6 shows the example portable shade apparatus 20 from one angle. FIG. 7 shows the example portable shade apparatus 20 from a different angle. FIG. 8 shows the example portable shade apparatus 20 from yet a different angle.

In particular, the cables 26 connect to a back portion of the fence 100. Such a situation may be well-suited if the sun is immediately overhead and can be the installation configuration before, after or in the alternative to that of FIGS. 4 and 5. Along these lines, the sheet of material 22 is more horizontal than that of the orientation shown in FIGS. 4 and 5. With such adjustments to the portable shade apparatus 20 in mind, it is unnecessary for people that receive shade from the portable shade apparatus 20 to move to a new location. Rather, the people may continue to reside in the same location (e.g., sit on an adjacent bench) since the portable shade apparatus 20 is adjusting to provide continuous shade.

As shown in FIG. 8, the cables 26 pull the second end sections 32 of the flexible rods 24 away from each other thus enabling the sheet of material 22 to remain taut. In some arrangements, the example portable shade apparatus 20 further includes a lateral support member (also see FIG. 1) that prevents the middle section of the sheet of material 22 from excessively sagging.

Figure 9:
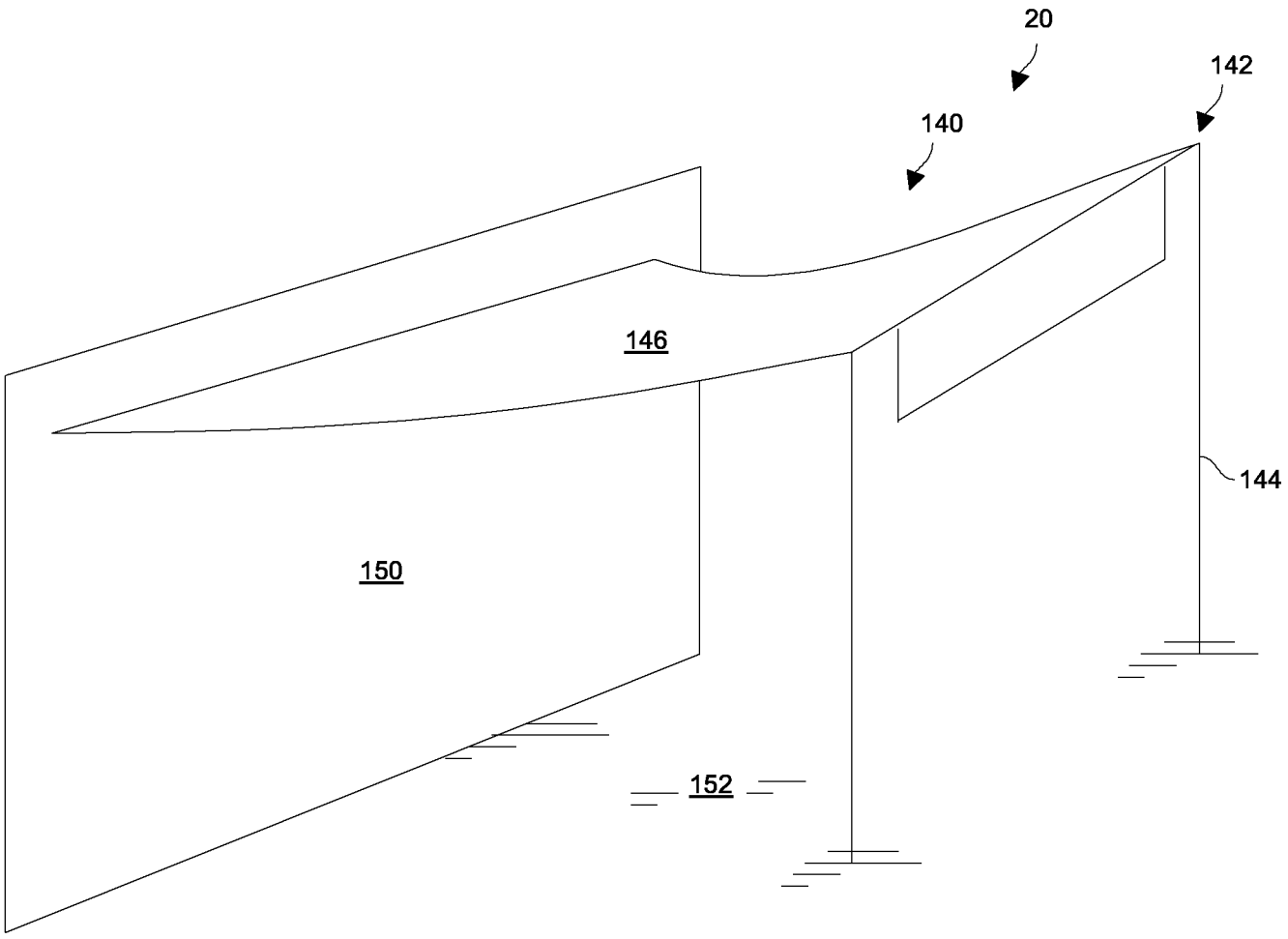
FIG. 9 shows another example portable shade apparatus in accordance with certain embodiments.
Figure 10:
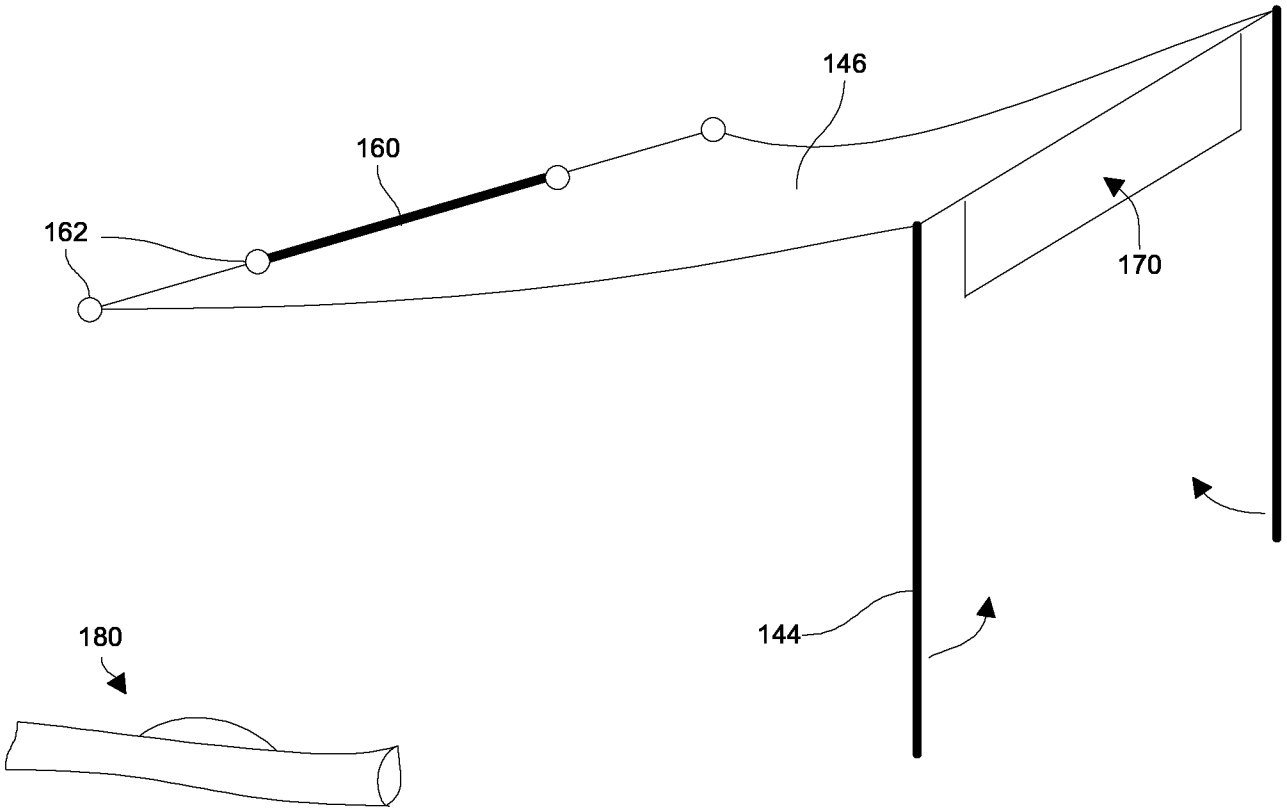
FIG. 10 shows yet another example portable shade apparatus in accordance with certain embodiments.

It should be understood that other embodiments exist for the portable shade apparatus 20 as well. FIGS. 9 and 10 show particular details of an alternative embodiment in which one side of the sheet of material 22 fastens to a fence, and the opposite side is supported by legs. In such an embodiment, the sheet of material 22 provides shade over a bench area. Additionally, the sheet of material 22 provides locations on which to display banners containing team information, logos, colors, etc. Moreover, the portable shade apparatus 20 is easily packed into a carrying bag/carrier 28 for mobility.

In the embodiment of FIGS. 9 and 10, the portable shade apparatus 20 includes components 140 such as a set of fasteners 142, a set of legs 144, and a sheet of material 146 coupled to the set of fasteners 142 and the set of legs 144. At least a portion of the sheet of material 146 is at least partially transparent (e.g., includes a weave or mesh-like material, etc.). Each fastener 142 of the set of fasteners 142 (e.g., hooks, clasps, connectors, combinations thereof, etc.) is constructed and arranged to fasten the sheet of material 146 to a fence or fence-like structure 150. Each leg 144 of the set of legs 144 is constructed and arranged to support the sheet of material 146 over a bench area 152 adjacent the fence 150.

In certain embodiments, the components 140 include hooks 160 to attach to a fence or fence-like structure, a bar member 162 that telescopes/shrinks to provide lateral support to the sheet of material 146. Additionally, the sheet of material 146 includes a portion 170 that supports a team artifact (e.g., a logo, a banner, etc.). Furthermore, the legs 144 are able to telescope into smaller lengths and/or fold (see arrows in FIG. 10) in order to fit into a bag 180 for storage and/or transport.

Figure 11:
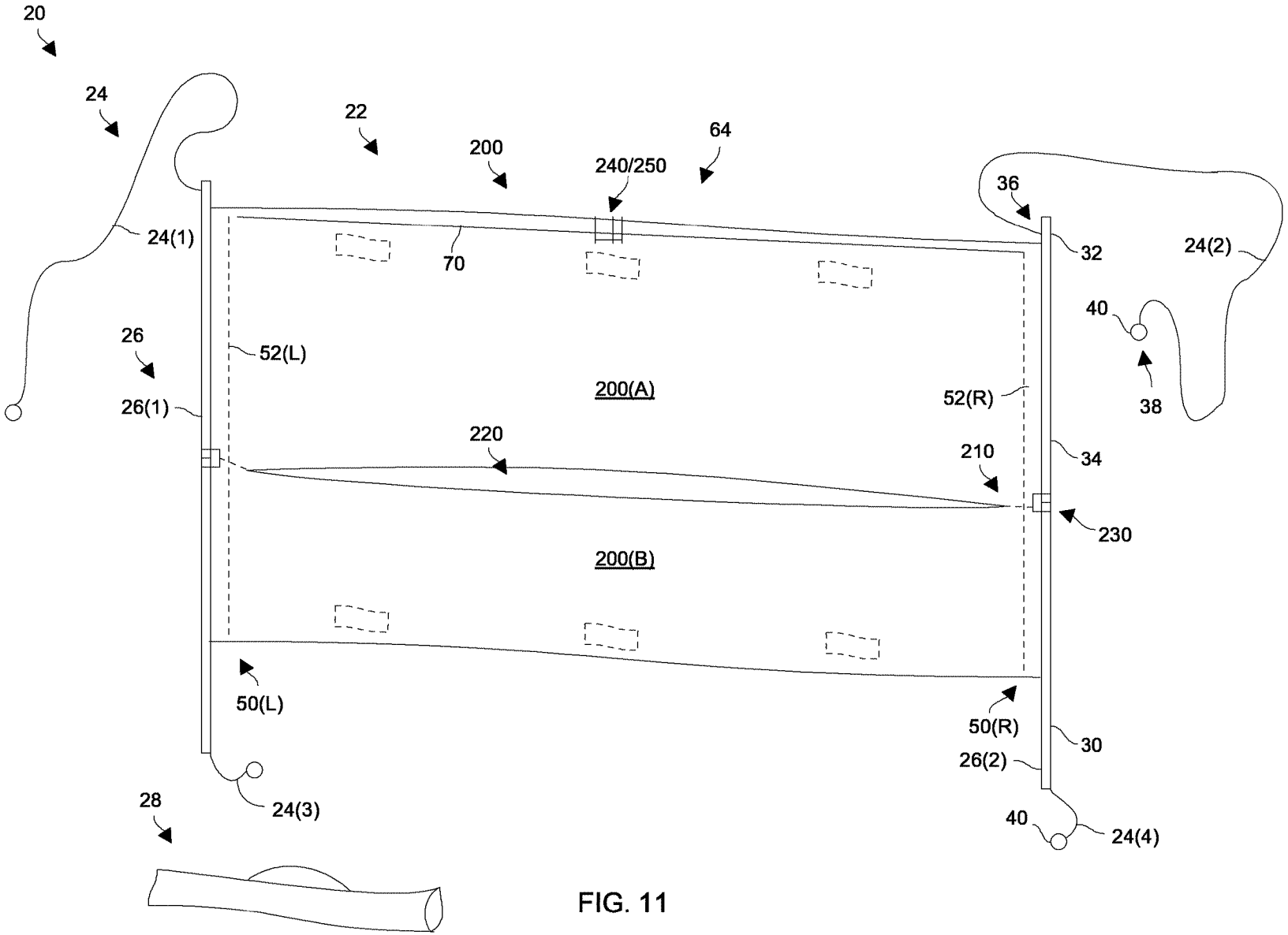
FIG. 11 shows yet another example portable shade apparatus in accordance with certain embodiments.

FIG. 11 shows, in accordance with certain embodiments, another portable shade apparatus 20 that includes a sheet of material 22 that is formed by one or more sections 200(A), 200(B), . . . (collectively, sections 200). The sections 200 may be able to completely detach from each other, or attach intermittently, e.g., see area 210. As a result, the portable shade apparatus 20 provides one or more openings 220 for additional functionality. For example, such openings 220 enable wind to more easily pass through thus enabling the portable shade apparatus 20 to withstand stronger wind gusts without sustaining damage. Additionally, when the portable shade apparatus 20 is flush with the fence 100 (e.g., see FIG. 4), players are able to fasten (e.g., hook) equipment bags to the fence 100 through an opening 220 while still enjoying sun protection (e.g., against strong sunlight while at sunrise or sunset when sunlight approaches at a substantially horizontal angle).

It should be understood that, each opening 220 within the sheet of material 22 may be a simple slot (e.g., a gap, a hole, etc.) to enable easy passage of air (e.g., easy release of trapped hot air). Alternatively, one or more of the openings 220 may be formed by overlapping material (e.g., a flap) to provide maximum shade.

As further shown in FIG. 11, each flexible rod 26 may separate (or hinge) into multiple rod sections thus enabling disassembly into smaller pieces for smaller compaction and easier transport. Along these lines, the rod sections then may be stored within a small bag 28 which may fit easily into a trunk of a vehicle. To facilitate access to the mid portions of the flexible rods 26 for disassembly, the sheet of material 22 may provide access openings 230.

Likewise, the lateral support member 70 may separate or hinge at one or more locations 240. Furthermore, these connection points 240 for the lateral support member may be directly accessible via access openings 250.

In certain embodiments, one rod section nests within another rod section (e.g., insert, engage, telescope from, etc.). Additionally, in accordance with certain embodiments, the rod sections may twist relative to each other to provide robust and reliable locking together. Furthermore, in accordance with certain embodiments, each flexible rod 26 may connect via an elastic cord or rope that pulls the ends of the rod sections together thus preventing the rod sections from inadvertently disconnecting from each other.

Furthermore, it should be understood that the portable shade apparatus 20 was described above as being operative to fasten to a fence 100. In certain embodiments, the portable shade apparatus 20 is constructed and arranged to fasten to other structures such as to a tent, the back of a deck, an awning, or other fence-like structure. In some arrangements, the portable shade apparatus 20 is able to attach the side of a standing tent to block sun as well as provide some privacy. However, in contrast to a conventional tent that may have a side that attaches via Velcro®, the portable shade apparatus 20 is made of a lighter material perhaps with some transparency and may simply clip on to two legs of the standing tent. Moreover, if the legs of the standing tent taper, the portable shade apparatus 20 may easily taper as well to fit uniformly along the legs of the standing tent. Such modifications and enhancements are intended to belong to various embodiments of the disclosure.

What is claimed is:

1. A portable shade apparatus, comprising:

a sheet of material;

a set of cables; and a set of flexible rods coupled to the sheet of material and the set of cables, each flexible rod of the set of flexible rods having (i) a first end section which projects from the sheet of material, (ii) a second end section which fastens to a respective cable of the set of cables, and (iii) an inner section between the first end section and the second end section, the inner section providing support to the sheet of material;

wherein the inner section of each flexible rod of the set of flexible rods bends in an arc to prop up the sheet of material as a shade when the first end section of that flexible rod fastens to a fence and the second end section of that flexible rod is pulled under tension by a respective cable of the set of cables;

wherein the first end section of each flexible rod of the set of flexible rods projects from the sheet of material in a cantilevered manner to fasten to the fence;

wherein the first end section of each flexible rod of the set of flexible rods projects from the sheet of material by at least 12 inches while propping up the sheet of material as the shade;

wherein the fence is a chain link fence; and wherein the first end section of each flexible rod of the set of flexible rods is bendable to permit weaving of the first end section of that flexible rod through openings in the chain link fence to attach that flexible rod to the fence.

2. A portable shade apparatus as in claim 1 wherein each flexible rod of the set of flexible rods is formed uniformly of a polymeric substance that provides elasticity while under tension.

3. A portable shade apparatus as in claim 1 wherein each cable of the set of cables has (i) a rod end that attaches to the second end section of a respective flexible rod of the set of flexible rods and (ii) an anchor end which anchors to an anchor point.

4. A portable shade apparatus as in claim 3 wherein the anchor point is a portion of a fence; and wherein the anchor end of each cable includes a mechanical coupler to anchor that cable to the portion of the fence.

5. A portable shade apparatus as in claim 4 wherein the mechanical coupler of each cable of the set of cables is a metallic clasp that fits around a wire of the chain link fence to anchor that cable to the chain link fence.

6. A portable shade apparatus as in claim 5 wherein the metallic clasp of each cable of the set of cables is spring loaded.

7. A portable shade apparatus as in claim 1 wherein the sheet of material has (i) a left edge which is supported by a first flexible rod of the set of flexible rods and (ii) a right edge which is supported by a second flexible rod of the set of flexible rods.

8. A portable shade apparatus as in claim 7 wherein the left edge of the sheet of material defines a left sleeve that holds the first flexible rod and a right sleeve that holds the second flexible rod.

9. A portable shade apparatus as in claim 7 wherein at least a portion of the sheet of material is semitransparent allowing light to at least partially pass therethrough when the sheet of material is taut.

10. A portable shade apparatus as in claim 7 wherein the sheet of material includes a set of banner location areas for displaying a set of banners.

11. A portable shade apparatus as in claim 10 wherein the set of banner location areas includes a central region disposed between the left edge and the right edge, the central region providing a presentation surface for banner display.

12. A portable shade apparatus as in claim 10 wherein the set of banner location areas includes an edge region for banner hanging.

13. A portable shade apparatus as in claim 1, further comprising:

an elongated bag;

wherein the sheet of material, the set of cables, and the set of flexible rods are constructed and arranged to fit within the elongated bag during transportation of the portable shade apparatus.

14. A portable shade apparatus as in claim 1 wherein the first end section of each flexible rod fastens to another respective cable of the set of cables.

15. A portable shade apparatus as in claim 1 wherein each flexible rod is operative to separate into multiple rod sections for disassembly during transport.

16. A method for installing a portable shade apparatus on a fence adjacent a bench area of an athletic field, the method comprising:

unfurling the portable shade apparatus, the portable shade apparatus including:

a sheet of material, a set of cables, and a set of flexible rods coupled to the sheet of material and the set of cables, each flexible rod of the set of flexible rods having (i) a first end section which projects from the sheet of material, (ii) a second end section which fastens to a respective cable of the set of cables, and (iii) an inner section between the first end section and the second end section, the inner section providing support to the sheet of material;

after the portable shade apparatus is unfurled, inserting the first end section of each flexible rod of the set of flexible rods through openings in the fence adjacent the bench area of the athletic field; and anchoring each cable of the set of cables to a respective anchor point to bend the set of flexible rods in a manner which holds the sheet of material taut in the form an arc while the sheet of material provides shade over the bench area;

wherein anchoring each cable of the set of cables includes:

attaching each cable to a respective original location on the fence; and wherein the method further comprises:

re-attaching each cable to a respective new location on the fence to maintain shade over the bench area;

wherein the inner section of each flexible rod of the set of flexible rods bends in an arc to prop up the sheet of material as a shade when the first end section of that flexible rod inserts though the openings in the fence and the second end section of that flexible rod is pulled under tension by a respective cable of the set of cables;

wherein the first end section of each flexible rod of the set of flexible rods projects from the sheet of material in a cantilevered manner to fasten to the fence;

wherein the first end section of each flexible rod of the set of flexible rods projects from the sheet of material by at least 12 inches while propping up the sheet of material as the shade;

wherein the fence is a chain link fence; and wherein the first end section of each flexible rod of the set of flexible rods is bendable to permit weaving of the first end section of that flexible rod through openings in the chain link fence to attach that flexible rod to the fence.

17. A portable shade apparatus, comprising:

a sheet of material;

a set of cables; and a set of flexible rods coupled to the sheet of material and the set of cables, each flexible rod of the set of flexible rods having (i) a first end section which projects from the sheet of material, (ii) a second end section which fastens to a respective cable of the set of cables, and (iii) an inner section between the first end section and the second end section, the inner section providing support to the sheet of material;

wherein the inner section of each flexible rod of the set of flexible rods is constructed and arranged to bend in an arc to prop up the sheet of material as a shade when the first end section of that flexible rod fastens to a fence and the second end section of that flexible rod is pulled under tension by a respective cable of the set of cables;

wherein the first end section of each flexible rod of the set of flexible rods projects from the sheet of material in a cantilevered manner to fasten to the fence;

wherein the fence is a chain link fence; and wherein the first end section of each flexible rod of the set of flexible rods is bendable to permit weaving of the first end section of that flexible rod through openings in the chain link fence to attach that flexible rod to the fence.

18. A portable shade apparatus as in claim 17 wherein each cable of the set of cables includes a mechanical coupler that fastens to an anchor point of the fence to anchor that cable to the chain link fence.

19. A portable shade apparatus as in claim 17 wherein sheet of material provides a banner section which is constructed and arranged to display a banner.

20. A portable shade apparatus as in claim 17 wherein each flexible rod is operative to separate into multiple rod sections for disassembly during transport.

* * * * *